US005144875A

United States Patent [19]

Nakada

[11] Patent Number: 5,144,875

[45] Date of Patent: Sep. 8, 1992

[54] MUSIC SHEET

[75] Inventor: Akira Nakada, Hamamatsu, Japan

[73] Assignee: Yamaha Corporation, Japan

[21] Appl. No.: 570,436

[22] Filed: Aug. 21, 1990

Related U.S. Application Data

[60] Division of Ser. No. 421,934, Oct. 16, 1989, abandoned, which is a continuation of Ser. No. 175,580, Mar. 29, 1988, abandoned, which is a continuation of Ser. No. 352,684, Feb. 26, 1982, abandoned.

[30] Foreign Application Priority Data

Nov. 14, 1981 [JP] Japan ..... 56-170089

[51] Int. Cl.[5] ..... G10H 1/38; G10H 1/42

[52] U.S. Cl. ..... 84/611; 84/613; 84/471 R; 84/483.1

[58] Field of Search ..... 84/609-614, 84/471 R, 483.1, 483.2

[56] References Cited

U.S. PATENT DOCUMENTS 4,413,545 1/1983 Okamoto et al. ..... 84/609

*Primary Examiner*—Stanley J. Witkowski

*Attorney, Agent, or Firm*—Remy J. VanOphem

[57] ABSTRACT

There is provided a music sheet having a magnetic data recording section. The magnetic data recording section is provided in parallel with a lower edge of the sheet and stores automatic performance data for manual performance, a front surface of the sheet is described with a music including an introduction and an ending, and a rear surface that is described with an advice or guidance for performing the music. The music sheet is convenient not only to a not yet skilled performer but also to a skilled performer in order to perform or exercise the music.

30 Claims, 13 Drawing Sheets

MUSIC SHEET

CROSS REFERENCE TO RELATED APPLICATIONS

This is a division of application Ser. No. 07/421,934, filed Oct. 16, 1989, now abandoned, which was a continuation of Ser. No. 07/175,580, filed Mar. 29, 1988, now abandoned, which was a file wrapper continuation application of Ser. No. 06/352,684, filed Feb. 26, 1982, now abandoned.

BACKGROUND OF THE INVENTION

This invention relates to a music sheet and more particularly a rectangular music sheet for selective use with an electronic music producing device.

A conventional music sheet generally includes one or more sheets written or printed with music, various recommendations regarding a tone color, an effect, an accompaniment, etc. which are necessary for the performance of the music, and a text. As is well known, however, such a music sheet cannot be performed correctly without a certain degree of musical knowledge and technique of performance.

The recent development of electro-technique has been applied to the field of musical instruments. Many types of inexpensive and compact electronic musical instruments have been proposed having keyboards and tone producing means capable of manually selecting a tone color and an effect in accordance with the operator's desire, these musical instruments additionally being capable of performing an accompaniment. Further, it has been desired to provide an electronic musical instrument and software therefor with which anyone can readily perform or practice at any place.

To meet this requirement, an electronic musical instrument has been developed in which a musical composition, a tone color effect and an accompaniment, etc. are converted into bar codes consisting of pitch data, length data and chord data, and in which the bar codes are incorporated into a musical sheet. The bar codes are read out with an optical sensor, then stored in an electronic musical instrument and the musical composition is automatically performed according to the stored information. Alternatively, an operator can perform the music by a single key operation as if the performer is playing a musical instrument.

This type of electronic musical instrument may be said to be a revolutionary one because even an inexperienced performer can readily perform it automatically. However, since the bar codes occupy a substantial area of a music sheet, prior art sheet music using these codes have the following disadvantages.

The bar codes are constitued such that a note or symbol is represented by a combination of a predetermined number of thick and thin bars and spacings therebetween so that, although a short musical composition does not present any serious problem, in the case of a long musical composition accommodation of many codes in a single sheet enlarges the size thereof, thus making it impossible to make the music sheet of a definite and uniform size.

Accordingly, when the size of the musical sheet is a predetermined small size the number of sheets may increase. This contradicts the desire of the operator who wishes to carry and perform a compact electronic musical instrument in any place.

Moreover, a beginner or a not yet skilled operator requires a considerable amount of time and training until he or she can understand how to obtain a tone color, an effect and an accompaniment appropriate for a specific musical piece that can be produced by such a musical instrument. Thus, it is difficult for the operator to use the musical instrument as he wishes and the operator is obliged to seek the instruction of a teacher or to buy a text book.

SUMMARY OF THE INVENTION

Accordingly, it is a principal object of this invention to provide an improved music sheet capable of providing all necessary data when perfectly performing music with an automatic performing device and capable of informing the operator the advice or instructions necessary to effect the performance without any additional means.

Another object of this invention is to provide a music sheet capable of storing a substantial amount of data necessary for the performance or practice of a musical composition.

A further object of this invention is to provide a portable and compact music sheet.

A still further object of this invention is to provide a music sheet having a predetermined size convenient to carry and easy to handle and yet which can store a musical composition in its complete form.

To accomplish these and other objects, according to this invention, data necessary for the automatic performance of a musical composition is recorded in a magnetic data recording member of a narrow width and provided along one side of a rectangular sheet and data forming a written or printed musical composition is recorded in most of the remaining portion of the sheet. Further, advice and instructions relating to the performance of the musical composition is recorded on the other surface of the sheet.

More particularly, one surface of the sheet is inscribed with a musical composition including an introduction and an ending. The other surface of the sheet is provided with an auxiliary column in which are inscribed advice or instructions regarding performance of the music. A narrow magnetic data recording section or strip is provided on one side of the sheet for recording automatic performance data regarding the musical composition.

DESCRIPTION OF THE PREFERRED EMBODIMENT

Figure 1:
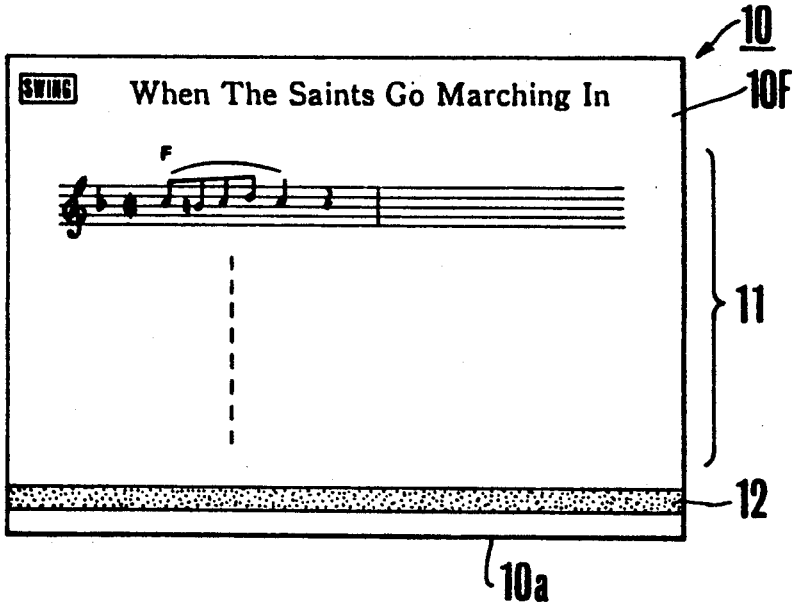
FIG. 1 is a front view of a music sheet embodying the invention.
Figure 2:
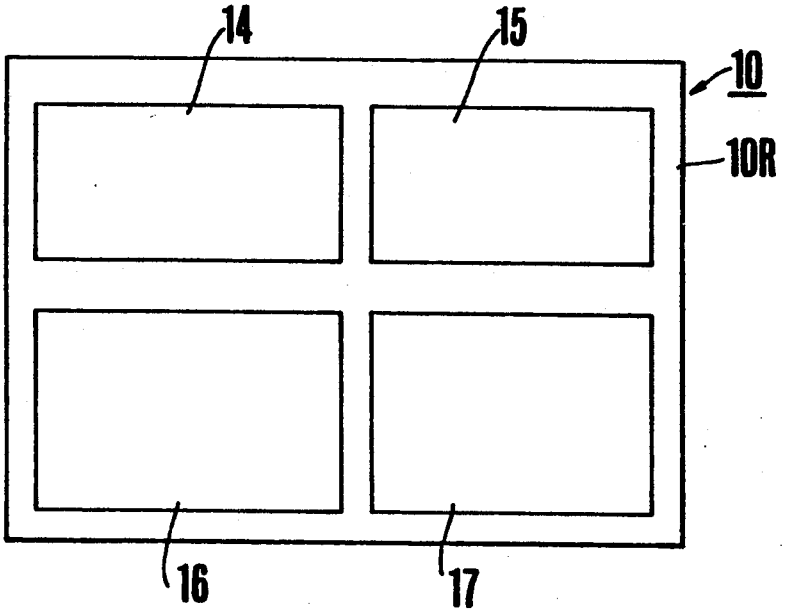
FIG. 2 is a rear view of the music sheet shown in FIG. 1.

The basic construction of a music sheet 10 embodying the invention is shown in FIGS. 1 and 2, in which the former shows the front surface 10F and the latter the rear surface 10R. The music sheet 10 is made of a material having a stiffness necessary for self-standing when placed on edge. For example, it has a thickness of about 0.2 through 0.5 mm, and preferably 0.3 mm and may be made of a sheet of paper. The sheet has a rectangular form of 182×257 mm. When the thickness of the sheet is less than 0.2 mm, it is difficult to self-stand and to handle and it tends to bend, whereas, when the thickness increases beyond 0.5 mm, it can readily self-stand but becomes bulky when a plurality of sheets are to be carried. Further, as the thickness increases, the cost of the sheet increases.

The major portion of the front surface 10F is occupied by a music describing section 11 in which a predetermined musical composition including an introduction and an ending is described, usually in the form of a score. Near the lower edge of the front surface is provided a magnetic data recording section 12 for recording automatic performance data. The magnetic data recording section 12 extends substantially in parallel with the lower edge of the sheet, is spaced about 6 mm therefrom, and has a width of about 6.5 mm. The reason for separating the magnetic data recording section 12 away from the edge of the music sheet 10 is that it would not be damaged even when the edge is worn out or slightly damaged. The magnetic data recording section 12 is prepared by bonding magnetic material to the surface 10F of the music sheet 10. As is well known, data can be recorded semipermanently in the magnetic section or strip at a much higher density than is possible in the prior art bar codes. Since the method of recording the data at such a high density is well known, it is not described herein in detail. In order to make it possible to repeatedly and correctly read out the data recorded in the magnetic data recording section 12 with a read out device, described later, a considerable durability is required for the sheet 10. For this reason, the music sheet should have an appropriate thickness described above.

As shown in FIG. 2 the rear surface 10R of the music sheet 10 is provided with a plurality of rectangular auxiliary columns 14, 15, 16 and 17 for printing or inscribing advice and instructions for the performance of the musical composition. Provision of the auxiliary columns assists a beginner or an unskilled operator to perform or practice the musical composition described on the front side by relying upon the inscriptions in these columns. For this reason, it is not necessary to read a separate advice or instruction paper or to ask a teacher.

The auxiliary column 14 is used to describe playing instructions and contains the following items:

EXAMPLE 1

*Entire Flow

Introduction 8 small sections-melody 8 small sections→act tone 2 small sections→melody 8 small section→D.C. (dacapo)→act tone 8 small sections→melody 8 small sections→act tone 2 small sections→melody 8 small sections→ending 2 small sections.

*Phase Number

Numbers are assigned to respective phrases of the music. Use them in a partial exercise of a melody.

*Keyboard Numbers

Lamps are lighted on the upperside of a keyboard in accordance with the order of performing a melody. If the operator masters playing by following the lamps, the operator may then turn off the lamps and perform without them.

EXAMPLE 2

*Flow of Play Card

Introduction 4 small sections→melody 16 small sections→melody 16 small sections.

*Tempo Set

Before turning ON the play, set the tempo as instructed, and then confirm the rhythm count with tempo lamps for the synchrostart.

*Phase Numbers and Free Tempo

Set a phrase number which the operator wishes to play. If the player cannot follow the tempo of the accompaniment, the player practices while observing lamps above the keyboard after setting to a free tempo.

According to the descriptions of examples 1 and 2, the progress of the performance of the entire musical composition is described on the front surface of the music sheet while reading the items of the entire flow.

In any event, the data described above is essential for the automatic performance, so that this data is recorded in the magnetic data recording section 12 on the front surface 10F of the sheet.

In the auxiliary column 15 are described sound instructions including the setting of such various operations as tone color, effect, and accompaniment (autobass chord, autorhythm, etc.) and manners of changing the setting are shown in the following example.

EXAMPLE 1

| | |
|---|---|
| Melody | vibraphone, |
| Obbligato | string |
| Rhythm | rock |
| Sound Advice | |

Play sequentially with different tone colors in accordance with a melody.

(Example, vibraphone→brass→flute→harpsichord→string)

Try to change the tone color from dacapo.

(Example, flute→dacapo→vibraphone).

In this example, as a manner of setting the tone color, a vibraphone is designated with reference to a melody, and string with reference to obbligato. The manner of changing the setting of the tone color includes a change from a vibraphone to a brass instrument, a flute, a harpsichord, and a string instrument, while the manner of changing the tone color includes changing from dacapo. Furthermore, with reference to the manner of setting the accompaniment, a rock tempo is designated as the autorhythm.

EXAMPLE 2

| | |
|---|---|
| melody | trumpet |
| obbligato | clarinet |
| rhythm | swing |
| single finger chord | OFF |

*Sound Advice

Try to change to the tone color of an organ from the phrase number "6". Regarding the manner of setting the tone color for a melody, a trumpet is shown, for obbligato a clarinet is shown, and a mode of setting the tone color is made by changing to an organ from phrase number "6". As the manner of setting the accompaniment, a swing is shown with regard to an automatic rhythm, and as the manner of setting the accompaniment turning OFF a single finger chord is shown. In this example is also shown the arrangement of operating members for the tone color, effect, accompaniment, etc. (see sound guidance shown in FIG. 11).

EXAMPLE 3

| | |
|---|---|
| melody | organ |
| obbligato | reed |
| rhythm | waltz |

*SOUND ADVICE

Can you enjoy various tone colors? Try to change the tone color for the first and second melodies.

(for example . . . first - organ, second - string)

Try to vary the tone color after phrase number "5".

(for example, after phrase number "5" add a sustain).

*RHYTHM ADVICE

Try to turn ON the multi-bass after "5".

Turn OFF when returned to "1".

In this example, as the manner of setting the tone color, an organ is shown for a melody, a reed is shown for obbligato, and as the manner of setting the tone color, change from an organ to strings is shown. Furthermore, as the manner of setting the effect, an addition of the sustain effect is shown. Further, as the manner of setting the accompaniment, waltz is shown for a rhythm while as the mode of changing the accompaniment setting, ON/OFF of multi-bass is shown.

In the auxiliary column 15 are described a sound guidance and a regist advice.

EXAMPLE 4

| | |
|---|---|
| melody | brass |
| obbligato | clarinet |
| rhythm | swing |
| Other tone colors | perform a tone color of a melody with a guitar or a piano. |

Try to change from two chorus (phrase number "5") to the tone color of strings.

In the auxiliary column 16 is described a solo performance guidance. For example, items shown in FIGS. 3A and 3B are printed therein.

Figure 3A:
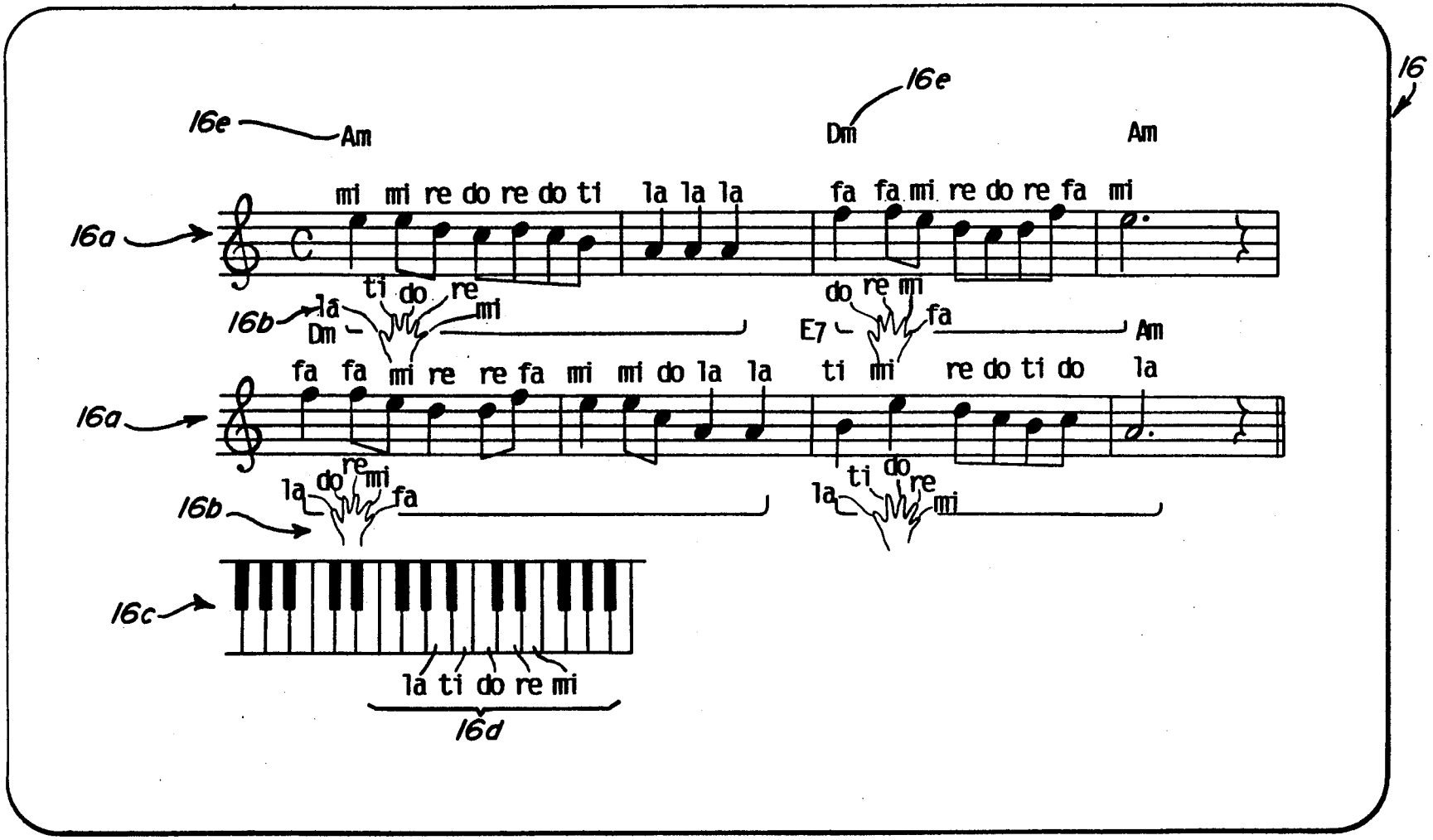
FIGS. 3A and 3B show examples of the inscriptions of the instructions for the solo performance to be recorded in the left lower auxiliary column on the rear side of the music sheet shown in FIG. 1.
Figure 3B:
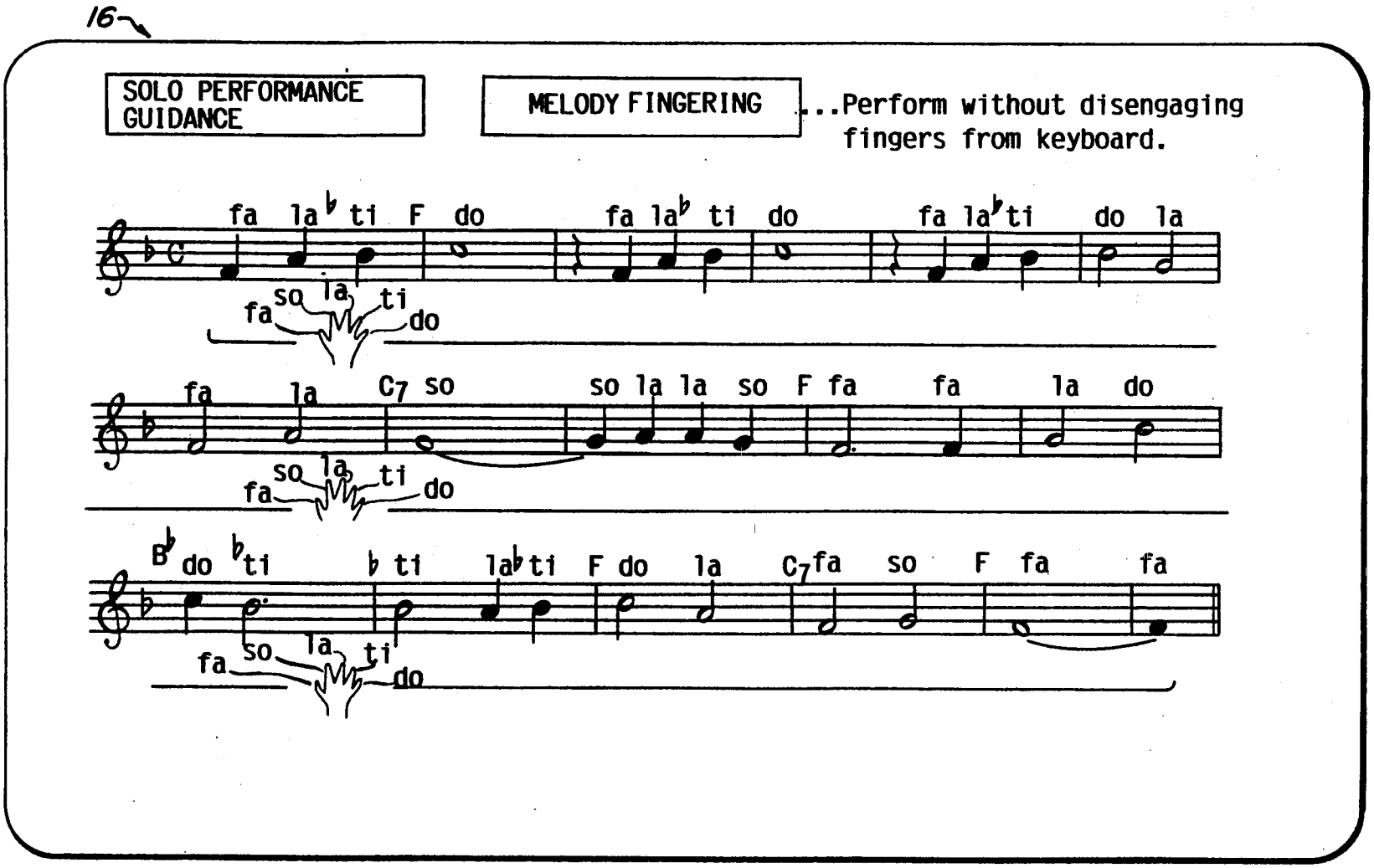

More particularly, in the case shown in FIG. 3A there is shown a musical score 16*a* for performing a musical score and fingering indices 16*b* including hand patterns interposed between the musical scores, which are utilized to perform the musical score. Beneath the lowermost score is described a keyboard arrangement 16*c*, the notes 16*d* (la, ti, do, re, mi, fa) of the keys depressed by the fingers and chord performing codes 16*e*. Similarly, FIG. 3B shows scores 16*a*, hand patterns 16*b* and the chord performing codes, as well as advice 16*f* for the key touch at the time of fingering and the relation to the chord.

Figure 4A:
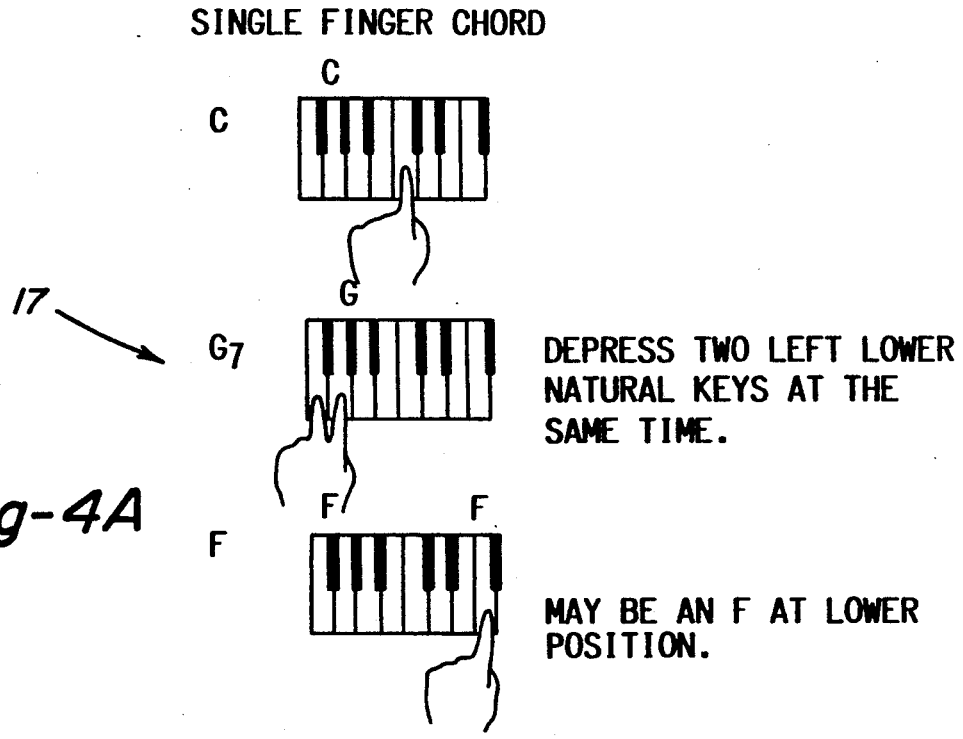
FIGS. 4A and 4B show examples of the inscriptions of a finger code in the right lower auxiliary column on the rear surface of the music sheet shown in FIG. 1.
Figure 4B:
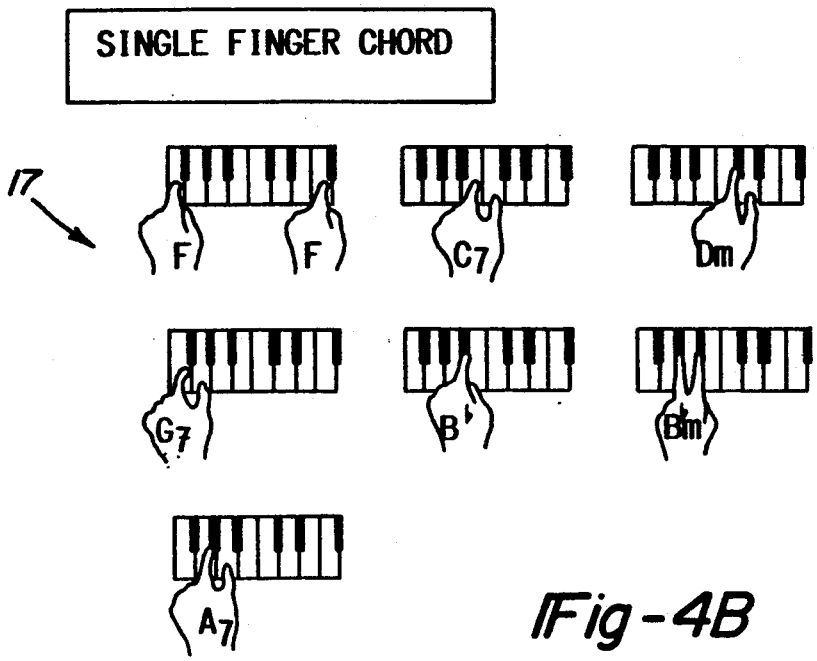

In the auxiliary column 17 is printed a single finger chord combined with a melody to be performed. For example, items shown in FIGS. 4A and 4B are printed therein. More particularly, in FIGS. 4A and 4B a keyboard arrangement and hand patterns for depressing keys to perform a chord in combination with a melody are printed such that the method of depressing for single finger performance can be made more efficiently.

The items described on the rear side 10R of a music sheet are not limited to those described in the example described above, and the order of the columns may be changed or other items may be printed therein.

Figure 5:
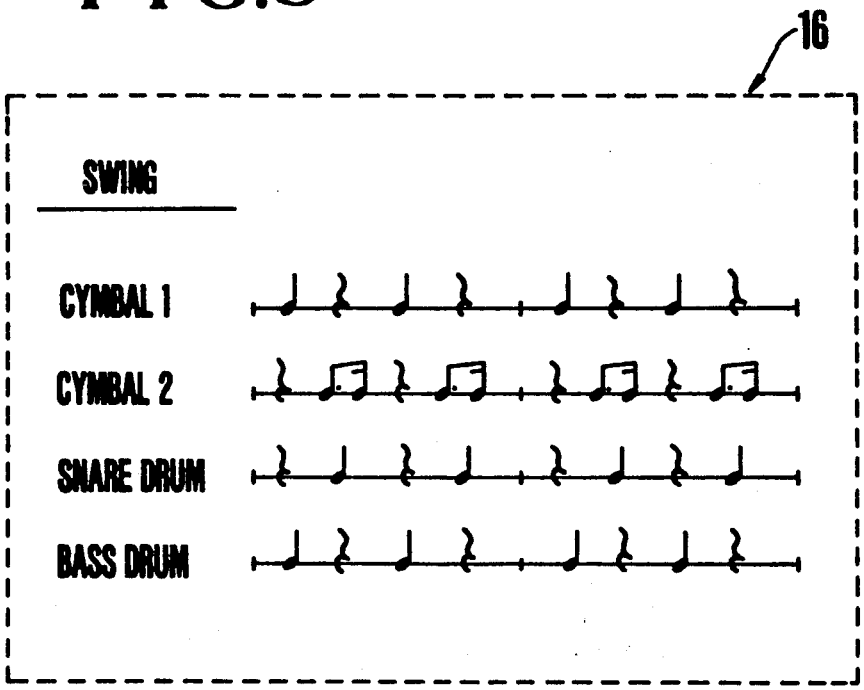
FIGS. 5 and 6 show examples of modified inscriptions in the left lower auxiliary column on the rear surface of the music sheet shown in FIG. 1.
Figure 6:
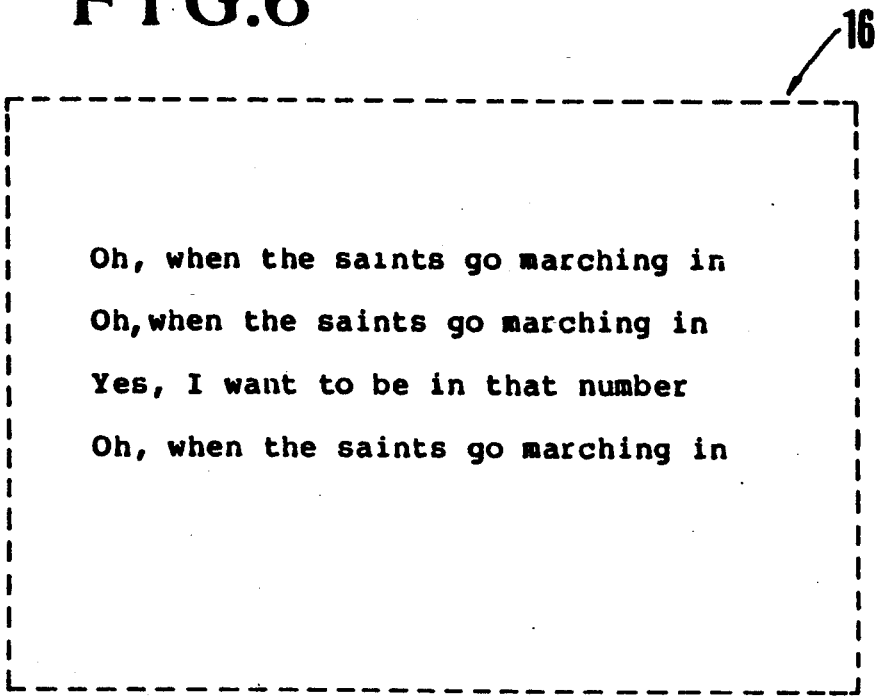

For example, in one of the auxiliary columns 16 may be printed a rhythm pattern as shown in FIG. 5 which is a rhythm pattern suitable for a musical score shown at the lower portion of the front surface 10F of the music sheet 10. In this example, the rhythm pattern of the swing are shown to correspond to four types of rhythm musical instruments, that is cymbals Nos. 1 and 2, a snare drum and a bass drum.

With such inscriptions too, the effectiveness of exercise of the performance can be enhanced.

The inscription in the auxiliary column 16 may be replaced with a text. Then it becomes possible to practice the musical performance while humming the text. Alternately, after storing data in a magnetic data recording device 12 to be described later, the music sheet is dismounted from the device and then the user can sing the text by seeing the same while performing an automatic performance.

Figure 7:
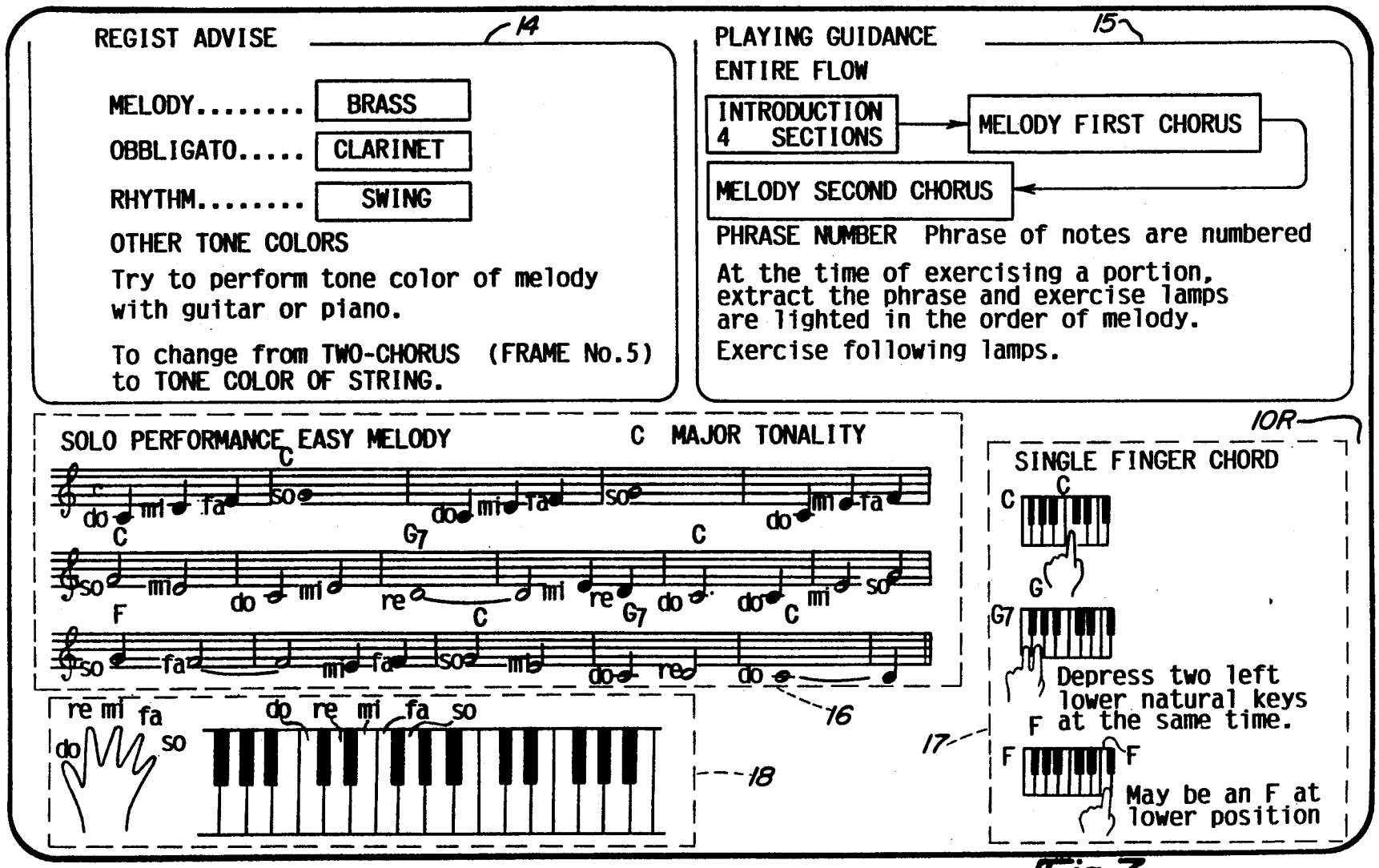
FIG. 7 shows another example of the rear surface of the music sheet embodying the invention.

Although in the foregoing embodiment, the rear surface 10R of the music sheet 10 was provided with four auxiliary columns, this number may be increased or decreased. For example, in an example shown in FIG. 7, five auxiliary columns 14 through 18 are formed in which the column 14 is inscribed with a regist advice, the column 15 inscribed with a playing guidance, the column 16 is provided with a solo performance, the column 17 is provided with a single finger chord, and the column 18 is inscribed with a fingering instruction. In this example, in the column 16 is described a simplified exercise melody obtained by simplifying the content of a melody obtained by converting the tonality into a C major tonality for the solo performance. In the auxiliary column 18 is described a hand pattern and the notes (do, re, mi, fa, so) related thereto of a keyboard, instead of describing them together with the solo performance as shown in FIGS. 3A and 3B.

Figure 8:
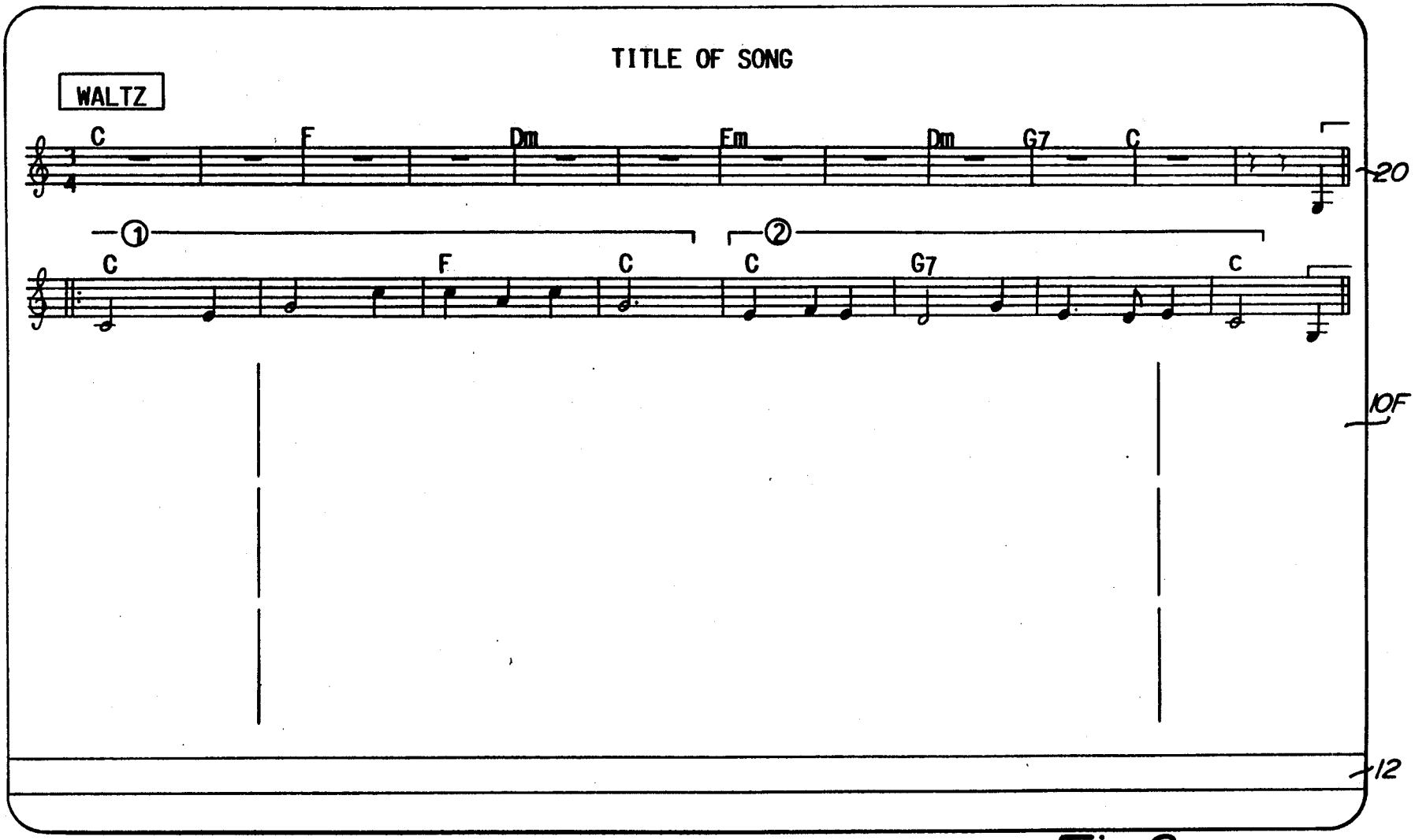
FIG. 8 shows another example of the front surface of the music sheet embodying the invention.
Figure 9:
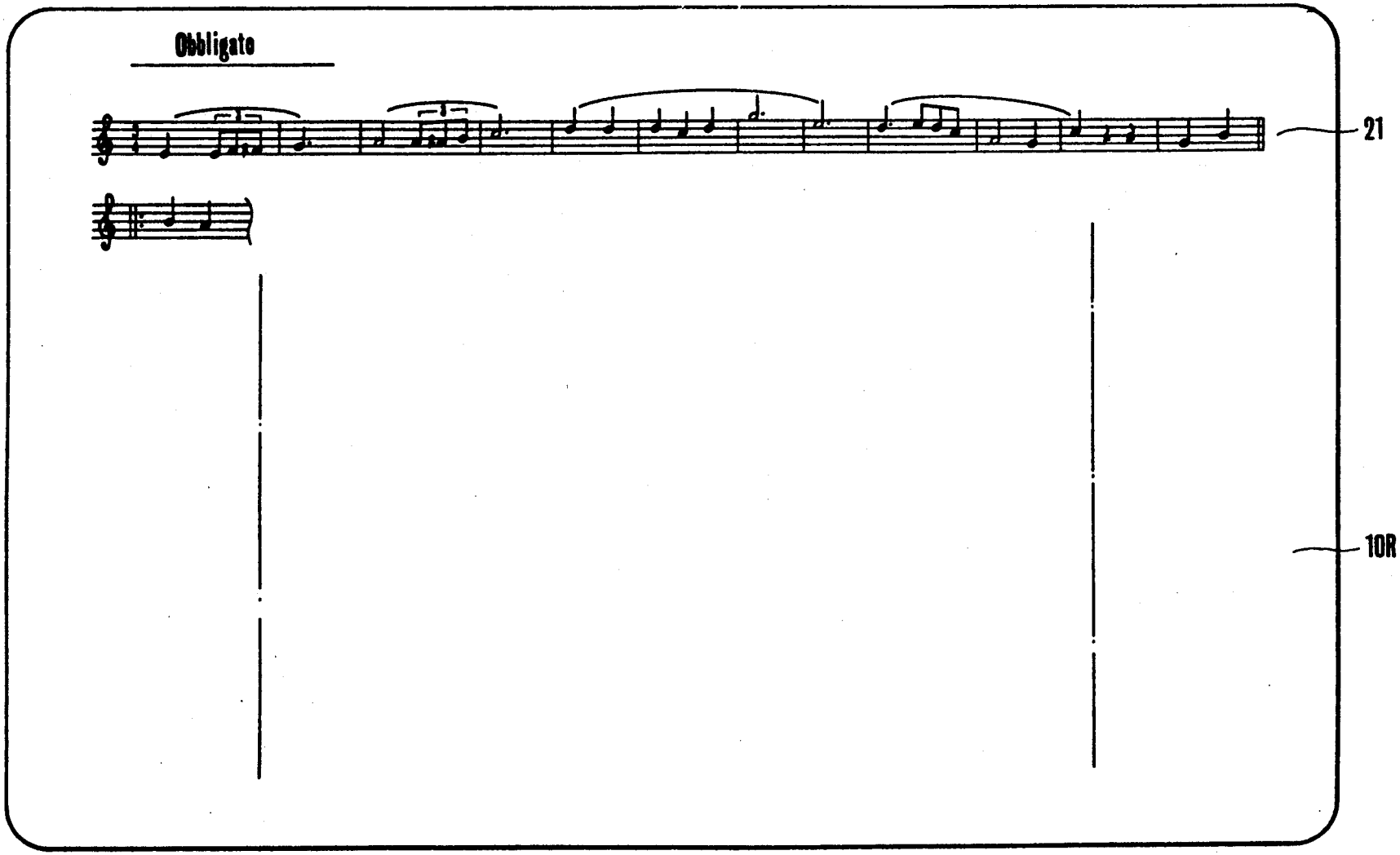
FIG. 9 shows still another example of the rear surface of the music sheet embodying the invention.

FIGS. 8 and 9 show only portions characterizing a modification of the music sheet of this invention. More particularly, as shown in FIG. 8, the front surface 10F of the music sheet 10 is provided with a first melody of a specific musical composition and the magnetic data recording section 12, like the foregoing embodiment. On the rear surface 10R is described a second melody of the music as an auxiliary means as shown in FIG. 9. The second melody described on the rear surface may include a counter melody or the like in addition to the obbligato shown in FIG. 9. By printing and magnetically encoding the first and second melodies on the same music sheet, practicing or performing the exercise can occur more efficiently. Although not shown in FIG. 9, it is advantageous to add at least one of the auxiliary columns described above.

Figure 10:
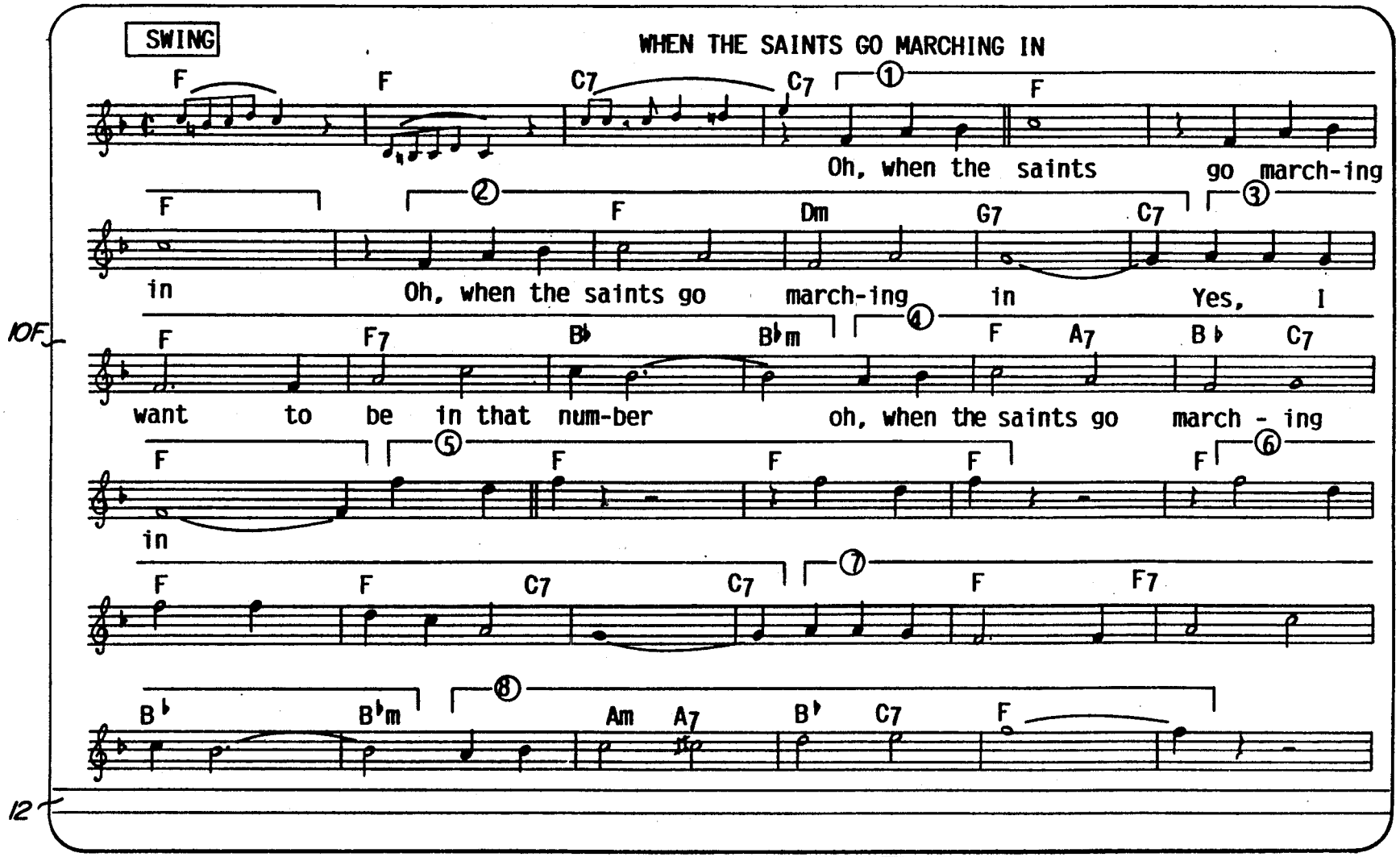
FIGS. 10, 11A and 11B show specific examples of the front surface and rear surface, respectively, of a music sheet embodying the invention.
Figure 11A:
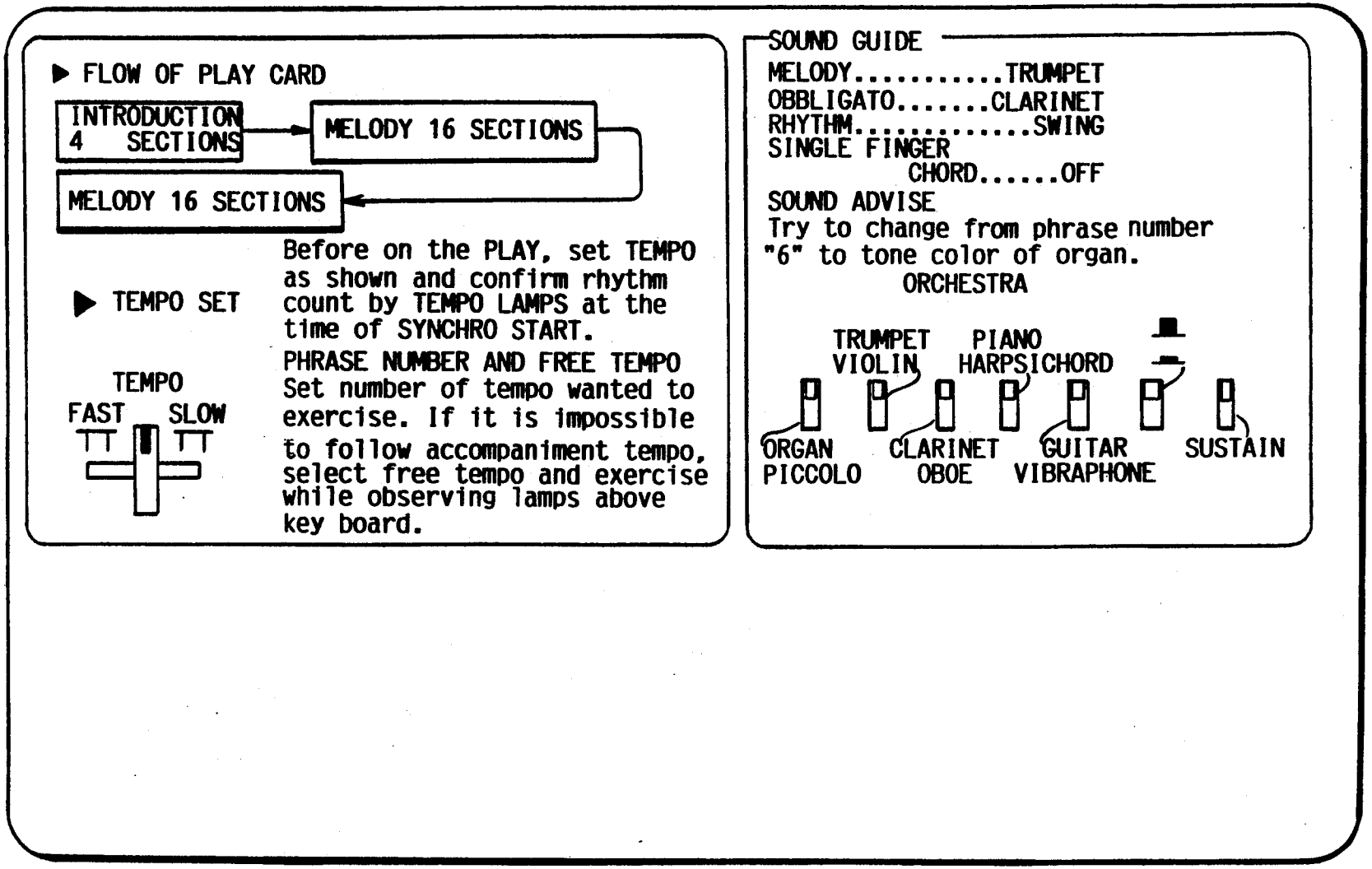
Figure 11B:
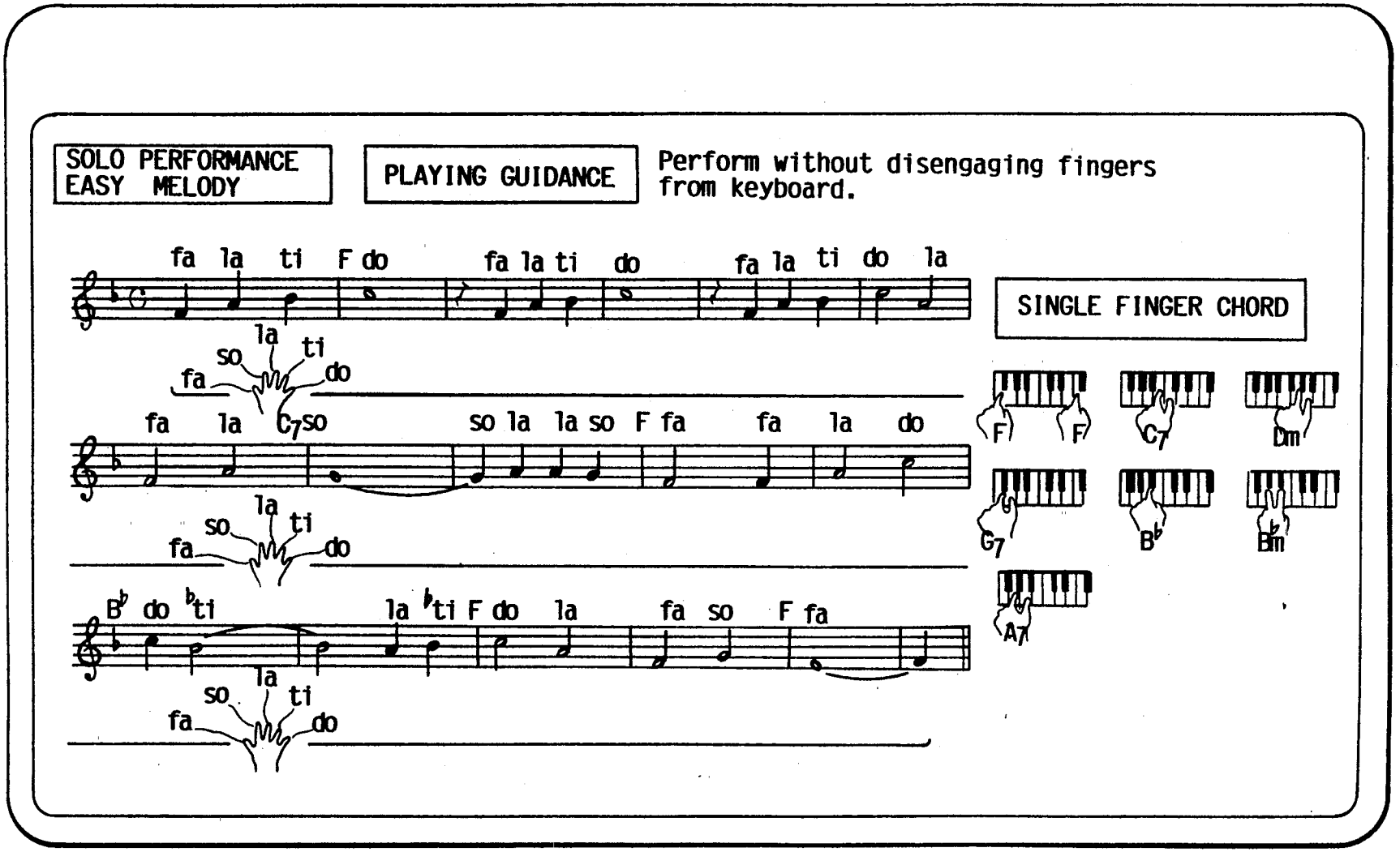

FIGS. 10 and 11 show a specific example of the music sheet embodying the invention. It should be understood that the music sheet of this invention can be modified variously. For example, the magnetic data recording section may be formed near the upper edge of the sheet or near the side edge. When impregnated with a small quantity of oil, the sheet can smoothly slide along a groove of the automatic performance device, described later, and can improve the durability of the sheet.

Figure 12:
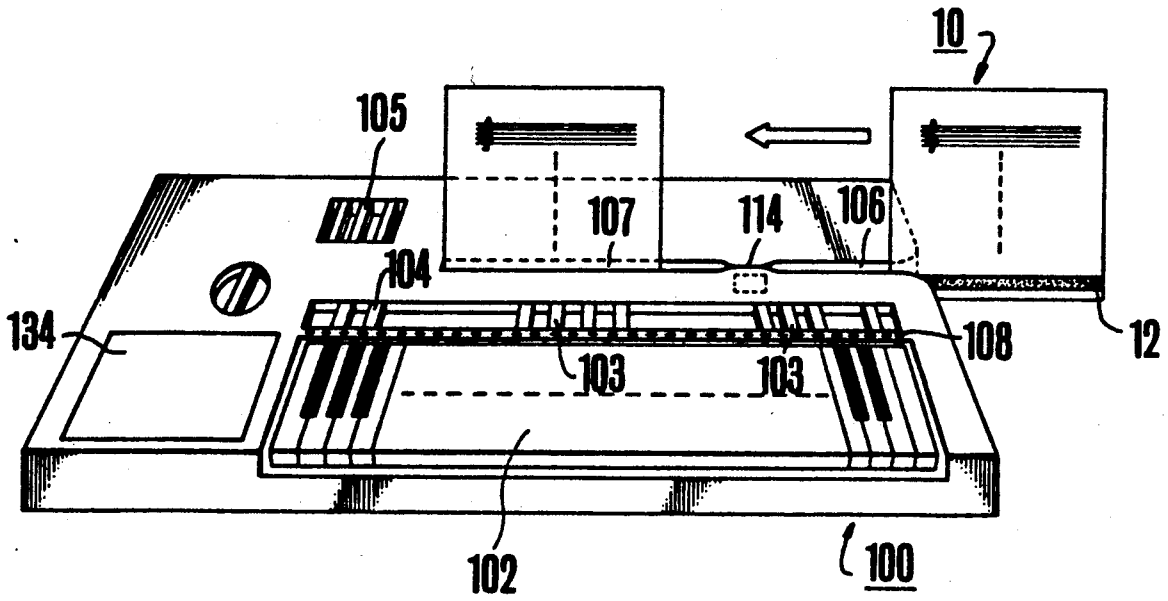
FIG. 12 is a perspective view showing an upper portion of an electronic musical instrument utilizing the music sheet of this invention.
Figure 13:
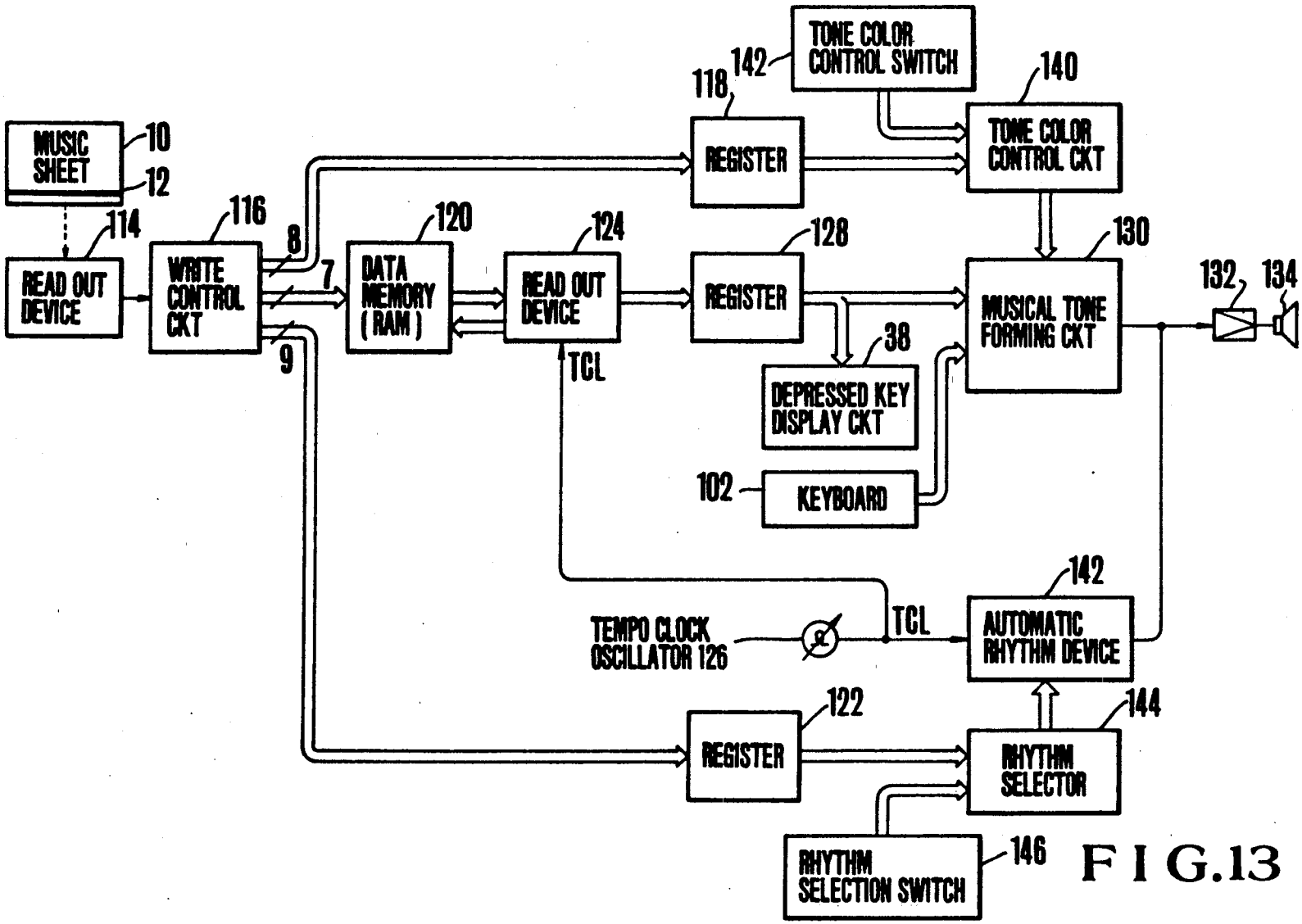
FIG. 13 is a block diagram showing the circuit construction of the electronic musical instrument utilizing the music sheet of the present invention.

FIGS. 12 and 13 show fundamental construction of an electronic musical instrument utilizing the music sheet of this invention and the circuit construction of the musical instrument. The electronic musical instrument 100 includes a keyboard 102, controls 103, 104 and 105 for controlling the tone color, the effect and the accompaniment, and aligned card grooves 106 and 107 in which the music sheet 10 is inserted. The magnetic data recording section 12 of a sheet 10 is inserted into the groove 106 from the right end thereof and then the sheet is moved toward the left end of the groove 107 by hand. Then, a read out device disposed intermediate the grooves 106 and 107 reads the data recorded in the recording section 12. Display means 108, constituted by lamps or light emitting diodes (LEDs), are provided above the keyboard for displaying the positions of the keys corresponding to keys producing tones in accordance with the stored data at the time of the automatic performance.

In FIG. 12, when a music sheet 10 is inserted into the grooves 106 and 107, a read out device 114 sequentially reads the automatic performance data from the data recording section 12 and writes them into a write control circuit 116 (see FIG. 13). The automatic performance data thus read out includes tone color data, rhythm type data, tone pitch and note length data regarding a melody, an obbligato, a counter melody and a chord. The write control circuit 116 writes tone color data in a register circuit 118, the tone pitch and note length data regarding the melody, the obbligato, the counter melody and the chord etc. in a data memory device 120 in the form of a random access memory (RAM), and the rhythm type data in a register 122.

Upon completion of these writing operations, a start switch, one of the controls 103 through 105 shown in FIG. 10, is turned ON to commence the automatic performance operation. Thus, in response to an ON signal of the start switch, a read out device 124 reads the tone pitch and the note length data out of the data memory device 120 corresponding to the first performed tone and, thereafter, counts the number of the tempo clock signals TCL generated by a tempo clock oscillator 126 for reading out the tone pitch and note length data of the next performance sounds at the end of the note length and supplies only the tone pitch data to a register 128. Consequently, the tone pitch data corresponding to respective performed tones are sequentially supplied to the register 128.

A musical tone forming circuit 130 is provided for electrically forming a musical tone in accordance with various tone pitch data (regarding a melody, obbligato, a counter melody, a chord, etc.) sequentially supplied from the register 128. Various musical tone signals formed by the musical tone forming circuit 130 are supplied to a loudspeaker 134 via an output amplifier 132 to produce a musical sound such as a melody, an obbligato, a counter melody, a chord etc. which are performed automatically.

The musical tone forming circuit 130 is constructed to form various musical tone signals in accordance with depressed key data produced by a manual operation of the keyboard 102. These musical tone signals are also supplied to the loudspeaker 134 through the output amplifier 132, whereby the loudspeaker 134 produces the manual performance tone too. The automatic performance tone and the manual performance tone are selectively produced by the operator by adjusting a volume.

In response to the tone pitch data supplied from the register 128, a depressed key display circuit 128 selectively lights display lamps provided for respective keys of the keyboard 102 to display keys to be depressed. For this reason, the performer can correctly depress the necessary keys by viewing the lamps. As described above with reference to the playing instructions, when the operator has mastered a musical composition to an extent such that he or she can play it without relying upon the display lamps, the operator may play the musical composition with the lamps turned OFF.

A tone color control circuit 140 is provided to initialize the tone color characteristic of the musical tone forming circuit 130 in accordance with the tone color data supplied from the register 118 and to set or modify the tone color characteristic of the musical tone forming circuit 130 before or during the performance based on the tone color setting data from a tone color control switch 141, one of the controls 103 through 105 shown in FIG. 12.

An automatic rhythm device 142 reads out a specific rhythm pattern designated by a rhythm selector 144 (selected by operating one of the controls or selectors 103 through 105 shown in FIG. 12) from the data memory device 120 in accordance with the tempo clock signal produced by the tempo clock oscillator 126 to drive a suitable rhythm tone source, not shown, for producing a rhythm tone signal which is also supplied to the loudspeaker 134 via the output amplifier 132. Thus, the loudspeaker 134 also produces the rhythm tone. For example, in response to the rhythm pattern data from the register 122 the rhythm selector 144 selects a given rhythm pattern, for example, waltz, and, in response to the rhythm type signal, the rhythm selector 144 selects or modifies a rhythm pattern before or during performance.

According to the electronic musical instrument described above, the musical tone forming circuit 130 can automatically perform a musical tone based on the data read out from the data memory 120. It is also possible to display keys of the keyboard 102 to be depressed so that the operator can efficiently exercise performance by referring to the automatically performed tone and the display of the keys to be depressed.

What is claimed is:

1. An aid system for a person to effect performance of a musical composition, comprising:

an electronic music producing device having a grooved portion;

data reading means in said grooved portion of said electronic music producing device;

a substantially rectangular music sheet having automatic performance data stored thereon, said music sheet further having sides, a front surface and a back surface, said front surface being inscribed with a musical composition, said musical composition comprising a score with musical codes for effecting a full manual performance of said musical composition, said back surface having at least one auxiliary column comprising instructions for effecting said manual performance of said musical composition; and a data recording section provided on one of said front and back surfaces of said sheet for storing said automatic performance data of said musical composition for performance by said electronic music producing device, said electronic music producing device effecting said automatic performance of said musical composition upon said data recording section of said music sheet having been inserted into said grooved portion of said electronic music producing device and having been read by said data reading means, whereby when a person desires to effect a performance of a musical composition on said electronic music producing device, reference to said instructions in said at least one auxiliary column on the back of said music sheet prompts said person to effect a simplified manual performance of said musical composition.

2. The aid system as claimed in claim 1 wherein one of said at least one auxiliary column is inscribed with setting conditions of operating members for a tone color, an effect and an accompaniment.

3. The aid system as claimed in claim 1 wherein one of said at least one auxiliary column is inscribed with setting changing manner of operating members for a tone color, an effect and an accompaniment.

4. The aid system as claimed in claim 1 wherein one of said at least one auxiliary column is inscribed with a manner of progress of the performance of said musical composition.

5. The aid system as claimed in claim 1 wherein one of said at least one auxiliary column is inscribed with a text of said musical composition.

6. The aid system as claimed in claim 1 wherein one of said at least one auxiliary column is inscribed with a finger pattern necessary to perform said musical composition.

7. The aid system as claimed in claim 1 wherein one of said at least one auxiliary column is inscribed with a melody for exercising said musical composition.

8. The aid system as claimed in claim 1 wherein one of said at least one auxiliary column is inscribed with a method of performing a chord of said musical composition.

9. The aid system as claimed in claim 1 wherein said musical composition inscribed on said front surface comprises a first melody of said musical composition and wherein one of said at least one auxiliary column on said back surface is inscribed with a second melody of said musical composition.

10. The aid system as claimed in claim 1 wherein one of said at least one auxiliary column is inscribed with a rhythm pattern.

11. The aid system as claimed in claim 1 wherein said music sheet has a thickness of 0.2 to 0.5 mm, to allow said music sheet to self-stand when viewed from each of said front and back surfaces.

12. The aid system as claimed in claim 1 wherein said data recording section is located at a predetermined distance from one of said sides of said music sheet such that said data recording section will not be damaged if said one of said sides of said music sheet becomes locally damaged.

13. The aid system as claimed in claim 1 wherein said automatic performance data comprises data for selecting a tone color, an effect and an accompaniment for said musical composition.

14. The aid system as claimed in claim 12 wherein said predetermined distance from said one of said sides of said music sheet is such that said music sheet can self-stand so that each of said front and back surfaces may be read when said data recording section of said music sheet is inserted in said electronic music producing device.

15. The aid system as claimed in claim 1 wherein said electronic music producing device has data reading means for reading said automatic performance data stored on said music sheet; said grooved portion of said electronic music producing device receiving said music sheet in a self-standing orientation.

16. The aid system as claimed in claim 15 wherein said at least one auxiliary column is inscribed with setting conditions of operating members for a tone color, an effect and an accompaniment.

17. The aid system as claimed in claim 15 wherein said at least one auxiliary column is inscribed with a manner of progress of the performance of said musical composition.

18. The aid system as claimed in claim 15 wherein said at least one auxiliary column is inscribed with a text of said musical composition.

19. The aid system as claimed in claim 15 wherein said at least one auxiliary column is inscribed with a finger pattern necessary to perform said musical composition.

20. The aid system as claimed in claim 15 wherein said at least one auxiliary column is inscribed with a melody for exercising said musical composition.

21. The aid system as claimed in claim 15 wherein said at least one auxiliary column is inscribed with a method of performing a chord of said musical composition.

22. The aid system as claimed in claim 15 wherein said musical composition inscribed on said front surface comprises a first melody of said musical composition and said at least one auxiliary column on said back surface is inscribed with a second melody of said musical composition.

23. The aid system as claimed in claim 15 wherein said at least one auxiliary column is inscribed with a rhythm pattern.

24. The aid system as claimed in claim 15 wherein said music sheet has a thickness of 0.2 to 0.5 mm to allow said music sheet to self-stand when viewed from each of said front and back surfaces.

25. The aid system as claimed in claim 24 wherein said data recording section is located at a predetermined distance from one of said sides of said music sheet such that said data recording section will not be damaged if said one of said sides of said music sheet becomes locally damaged.

26. The aid system as claimed in claim 25 wherein said predetermined distance from said one side of said music sheet is such that said music sheet can self-stand so that each of said front and back surfaces may be read when said data recording section of said music sheet is inserted in said grooved portion of said electronic music producing device.

27. The aid system as claimed in claim 14 wherein said automatic performance data includes data for selecting a tone color, an effect and an accompaniment for said musical composition.

28. The aid system of claim 1 wherein said electronic music producing device is an electronic keyboard music producing device; said data recording section of said music sheet is located substantially adjacent one of said sides thereof; said grooved portion is located on said electronic keyboard music producing device such that said music sheet may self-stand when inserted therein whereby said front and back surfaces thereof may be read; and wherein said electronic keyboard music producing device further comprises electronic means for performing said musical composition and simultaneously providing electronic signals for indicating keyboard performance data for said musical composition.

29. An aid system for a person to effect performance of a musical composition, comprising:

an electronic music producing device having a grooved portion;

data reading means in said grooved portion of said electronic music producing device;

a substantially rectangular music sheet having automatic performance data stored thereon, said music sheet further having sides, a front surface and a back surface, said front surface being inscribed with a musical composition, said musical composition comprising a score with musical codes for effecting a full manual performance of said musical composition, said back surface having at least one auxiliary column comprising inscriptions of settings of changing manner of operating members for a tone color, an effect and an accompaniment for effecting said manual performance of said musical composition; and a data recording section provided on one of said front and back surfaces of said sheet for storing said automatic performance data of said musical composition for performance by said electronic music producing device, said electronic music producing device effecting said automatic performance of said musical composition upon said data recording section of said music sheet having been inserted into said grooved portion of said electronic music producing device and having been read by said data reading means, whereby when a person desires to effect a performance of a musical composition on said electronic music producing device, reference to said settings of operating parameters for a tone color, an effect and an accompaniment prompts said person to effect a simplified manual performance of said musical composition.

30. An aid system for a person to effect performance of a musical composition, comprising:

an electronic music producing device having a grooved portion;

data reading means in said grooved portion of said electronic music producing device;

a substantially rectangular music sheet having automatic performance data stored thereon, said music sheet further having sides, a front surface and a back surface, said front surface being inscribed with a musical composition, said musical composition comprising a score with musical codes for effecting a full manual performance of said musical composition, said back surface having at least one auxiliary column comprising inscriptions of settings of changing manner of operating members for a tone color, an effect and an accompaniment for effecting said manual performance of said musical composition, said back surface further having at least one additional auxiliary column inscribed with a manner of progress of the performance of said musical composition; and a data recording section provided on one of said front and back surfaces of said sheet for storing said automatic performance data of said musical composition for performance by said electronic music producing device, said electronic music producing device effecting said automatic performance of said musical composition upon said data recording section of said music sheet having been inserted into said grooved portion of said electronic music producing device and having been read by said data reading means, whereby when a person desires to effect a performance of a musical composition on said electronic music producing device, reference to said settings of operating parameters for a tone color, an effect and an accompaniment prompts said person to effect a simplified manual performance of said musical composition.

* * * * *

UNITED STATES PATENT AND TRADEMARK OFFICE

CERTIFICATE OF CORRECTION

PATENT NO. : 5,144,875

DATED : September 8, 1992

INVENTOR(S) : Akira Nakada

It is certified that error appears in the above-identified patent and that said Letters Patent is hereby corrected as shown below:

Title page, under Foreign Application Priority Data, insert ---- Japanese Patent Application No. 7380/'82 filed January 22, 1982; Japanese Patent Application No. 7381/'82 filed January 22, 1982; Japanese Patent Application No. 7382/'82 filed January 22, 1982; Japanese Patent Application No. 7383/'82 filed January 22, 1982; Japanese Patent Application No. 7384/'82 filed January 22, 1982; Japanese Patent Application No. 7385/'82 filed January 22, 1982; Japanese Patent Application No. 7386/'82 filed January 22, 1982; and Japanese Patent Application No. 7387/'82 filed January 22, 1982 --

UNITED STATES PATENT AND TRADEMARK OFFICE

CERTIFICATE OF CORRECTION

PATENT NO. : 5,144,875 Page 2 of 2

DATED : September 8, 1992

INVENTOR(S) : Akira Nakada

It is certified that error appears in the above-indentified patent and that said Letters Patent is hereby corrected as shown below:

Column 4, line 34, line 27, delete "*Phase" and insert ---- *Phrase ----.

Column 8, line 24, delete "circuit 128" and insert ---- circuit 138 ----.

Column 9, line 42, after "setting" insert ---- of ----.

Signed and Sealed this

Third Day of August, 1993

*Attest:*

Michael K. Kirk

MICHAEL K. KIRK

*Attesting Officer*

*Acting Commissioner of Patents and Trademarks*